US009442501B2

(12) United States Patent
Pietri et al.

(10) Patent No.: US 9,442,501 B2
(45) Date of Patent: Sep. 13, 2016

(54) SYSTEMS AND METHODS FOR A LOW DROPOUT VOLTAGE REGULATOR

(71) Applicants: Stefano Pietri, Austin, TX (US); Chris C. Dao, Pflugerville, TX (US); Andre Luis Vilas Boas, Campinas (BR)

(72) Inventors: Stefano Pietri, Austin, TX (US); Chris C. Dao, Pflugerville, TX (US); Andre Luis Vilas Boas, Campinas (BR)

(73) Assignee: Freescale Semiconductor, Inc., Austin, TX (US)

( * ) Notice: Subject to any disclaimer, the term of this patent is extended or adjusted under 35 U.S.C. 154(b) by 154 days.

(21) Appl. No.: 14/287,395

(22) Filed: May 27, 2014

(65) Prior Publication Data

US 2015/0346748 A1 Dec. 3, 2015

(51) Int. Cl.

| | |
|---|---|
| ***G05F 1/575*** | (2006.01) |
| *G05F 1/59* | (2006.01) |
| *G05F 1/565* | (2006.01) |
| *G05F 3/26* | (2006.01) |

(52) U.S. Cl.

CPC ..... *G05F 1/575* (2013.01); *G05F 1/565* (2013.01); *G05F 1/59* (2013.01); *G05F 3/26* (2013.01)

(58) Field of Classification Search

CPC ..... G05F 1/575; G05F 1/56; G05F 1/565; G05F 1/468; G05F 1/59; G05F 3/26; H03F 1/342; H03F 3/45179; H03F 3/45183; H03F 1/0261; H03F 2200/153; H03F 2200/411; H03F 2200/453; H03F 2200/456; H03F 2203/45134; H03F 2203/45192; H03F 2203/45644; H03F 2203/45658; H03F 3/21; H03G 3/004; H03G 3/30

USPC ..... 323/273, 280, 91.1; 257/347, 351, 341; 330/254, 278

See application file for complete search history.

(56) References Cited

U.S. PATENT DOCUMENTS

| | | | | |
|---|---|---|---|---|
| 5,945,819 | A | 8/1999 | Ursino et al. | |
| 6,157,176 | A | 12/2000 | Pulvirenti et al. | |
| 6,388,433 | B2 | 5/2002 | Marty | |
| 6,975,099 | B2 | 12/2005 | Wu et al. | |
| 7,106,033 | B1 * | 9/2006 | Liu | G05F 1/575 323/280 |
| 7,106,037 | B2 * | 9/2006 | Ohtake | H02M 3/156 323/222 |
| 7,180,358 | B2 * | 2/2007 | Kwon | H03F 3/45179 327/346 |
| 7,199,565 | B1 | 4/2007 | Demolli | |
| 7,741,823 | B2 | 6/2010 | Terry et al. | |
| 2008/0180080 | A1 | 7/2008 | Terry et al. | |
| 2008/0303496 | A1 * | 12/2008 | Schlueter | G05F 1/575 323/273 |
| 2014/0117958 | A1 * | 5/2014 | Price | G05F 1/468 323/281 |

OTHER PUBLICATIONS

Milliken, R.J., et al., "Full On-Chip CMOS Low-Dropout Voltage Regulator", IEEE Transactions on Circuits and Systems-I: Regular Papers, vol. 54, No. 9, Sep. 2007.

* cited by examiner

*Primary Examiner* — Jessica Han
*Assistant Examiner* — Demetries A Gibson

(57) ABSTRACT

A semiconductor device including a voltage regulator is disclosed. The voltage regulator may include a multipath amplifier stage, a driver stage coupled to the multipath amplifier stage, a dynamic compensation circuit coupled to the multipath amplifier stage, and a current compensation circuit. The dynamic compensation circuit may be operable to provide a varying level of compensation to the multipath amplifier stage, where the varying level of compensation proportional to a current level associated with the load; and the current compensation circuit may be operable to allow a minimum current level at the driver stage.

19 Claims, 4 Drawing Sheets

SYSTEMS AND METHODS FOR A LOW DROPOUT VOLTAGE REGULATOR

BACKGROUND

1. Field

This disclosure relates generally to semiconductor devices, and more specifically, to a low dropout voltage regulator.

2. Related Art

Recent years have seen tremendous advancements in the field of electronic circuits. One such advancement is in the area of providing a supply voltage used to operate electronic circuits. The supply voltage may vary due to various factors such as changes in the load of the circuit to which the voltage is being supplied, temperature variations, aging, and so forth. Variation of the supply voltage can affect the operation of the electronic circuit. Thus, a voltage regulator is used to maintain the output of the supply voltage at a predetermined value. Over the years, a few different types of regulators have been developed, such as a standard regulator, a linear drop-out (LDO) regulator, and a quasi-LDO regulator, with LDO regulators being the most widely used.

A conventional LDO regulator includes an error amplifier, a pass-transistor, a capacitor, and resistance network. The error amplifier is connected to the gate of the pass-transistor. The source of the pass-transistor is connected to a voltage supply VDD and the drain of the pass-transistor comprises the output terminal of the LDO regulator. The capacitor is typically connected to the output of LDO regulator external to the device in which the LDO is implemented. The resistance network also is connected to the output of the LDO regulator and in parallel with the capacitor. A node between the resistors is connected to an input terminal of the error amplifier and provides a scaled-down version of the output voltage to the error amplifier. The error amplifier also receives a reference voltage signal that is generated by an external voltage reference circuit. The error amplifier compares the reference voltage signal and the scaled down version of the output voltage signal to generate an error amplified signal, which is provided to the gate terminal of the pass-transistor. The error amplified signal is used to maintain the output of the LDO regulator at a predetermined voltage.

The LDO regulator generates a constant output voltage to the load (not shown) by providing the required load current. If the magnitude of the load current increases due to variations in the load, there is a corresponding drop in the magnitude of the output voltage. The drop in the output voltage leads to an increase in the magnitude of the error amplified signal generated by the error amplifier. The increase in the error amplified signal in turn increases the magnitude of the source-gate voltage of the pass-transistor, causing a corresponding increase in the magnitude of the drain current of the pass-transistor, and the increase in the drain current pulls up the output voltage. Thus, the magnitude of the output voltage signal is maintained at the predetermined voltage. The capacitor connected to the output terminal improves the transient response of the LDO regulator.

During steady-state operation, the magnitude of the output voltage signal is maintained at the predetermined value and the output capacitor is charged to the magnitude of the output voltage signal. If the current of the load circuit changes abruptly and the main regulation loop, formed by the error amplifier, pass-transistor and resistor network, may not respond quickly because it has a bandwidth limitation, the capacitor provides the extra charge required by the load. As a result, the magnitude of the output voltage decreases or increases from the predetermined voltage value.

The magnitude of output voltage drop or rise can be improved by either increasing the bandwidth/speed of the main regulation loop or by increasing the value of the capacitor. However, such changes have associated constraints such as power consumption, silicon area, and overall cost of the system. To increase the bandwidth or speed of the main regulation loop, the DC current should be increased, which results in higher power consumption of the system and also increased die area. The external capacitor increases cost while an internal capacitor cannot be made very large because that would require significant additional die area. Thus, there is a need for a circuit that improves the transient response of the LDO regulator yet avoids the above-mentioned constraints.

BRIEF DESCRIPTION OF THE DRAWINGS

The present disclosure is illustrated by way of example and is not limited by the accompanying figures, in which like references indicate similar elements. Elements in the figures are illustrated for simplicity and clarity and have not necessarily been drawn to scale.

DETAILED DESCRIPTION

Figure 1:
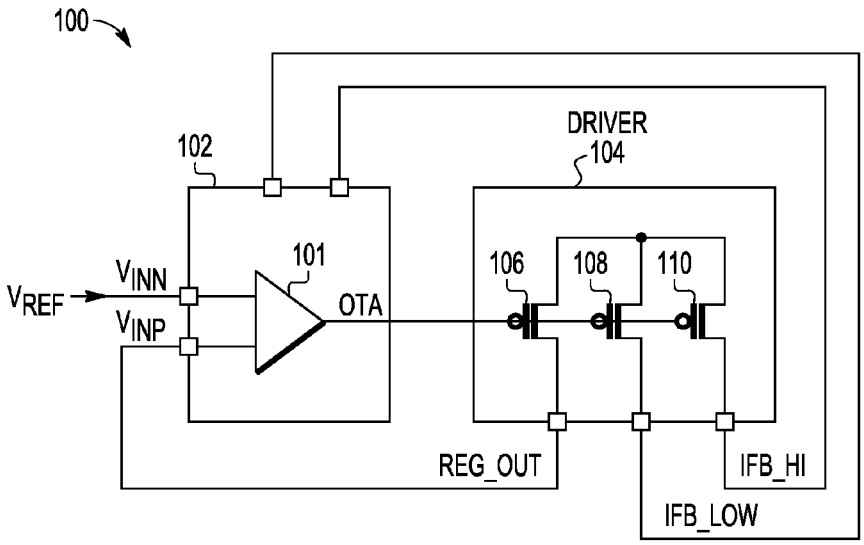
FIG. 1 shows a block diagram of a low dropout voltage regulator in accordance with some embodiments of the present disclosure.

Embodiments of systems and methods for a multi-path low drop out (LDO) voltage regulator are disclosed herein that can include a single substrate having circuitry to implement a first amplifier stage (204, 208) operable to provide a first gain level at a first bandwidth and a second amplifier stage (202) coupled to the first amplifier stage. The second amplifier stage can provide a second gain level at a second bandwidth. The first gain level is higher than the second gain level, and the second bandwidth is higher than the first bandwidth. A dynamic compensation circuit (206) coupled to the second amplifier stage can provide a varying level of compensation proportional to a current level associated with a load to the second amplifier stage. A current compensation circuit (212) coupled to an output of a third amplifier or driver stage (104) can allow a minimum current level at the third amplifier stage. The driver stage can be coupled to the first and second amplifier stages. The LDO voltage regulator reduces cost and the number of external components required to implement the LDO voltage regulator over known LDO regulators. The proposed regulator can supply one or more processing cores without requiring discrete external capacitors, regulating current load, for example, up to 350 milliAmperes (mA). Furthermore pins dedicated to a low core voltage are no longer required, reducing pad-ring limitations and increasing the number of functional pins available on the device.

FIG. 1 shows a block diagram of a low dropout voltage regulator 100 in accordance with some embodiments of the present disclosure that includes amplifier stage 102 and driver stage 104 (also referred to as amplifier stage 104). Amplifier stage 102 is represented as amplifier 101 coupled to receive a first input voltage (INN) in regulator 100, a second input voltage (INP), a high feedback current (IFB_HI), a low feedback current (IFB_LOW), regulator output voltage (REG_OUT), and a reference voltage (VREF). Amplifier 101 is shown as a representation of three amplifiers 202, 204, 208 in FIG. 2, but is shown as one amplifier in FIG. 1 to show the connections between amplifier stage 102 and driver stage 104.

An output voltage (OTA) of amplifier stage 102 is provided as an input to driver stage 104. In the embodiment shown, driver stage 104 includes P-channel transistors 106, 108, 110 with gate electrodes coupled to the output of amplifier stage 102. Drain electrodes of transistors 106, 108, 110 are coupled to one another. Drain electrode of transistor 106 is coupled to provide regulator output voltage (REG_OUT) to amplifier stage 102. Drain electrode of transistor 108 is coupled to provide a high current feedback signal (IFB_HI) to amplifier stage 102. Drain electrode of transistor 110 is coupled to provide regulator a low current feedback signal (IFB_LOW) to amplifier stage 102. The regulator output voltage (REG_OUT) can also be provided to drive an external load (not shown).

Figure 2:
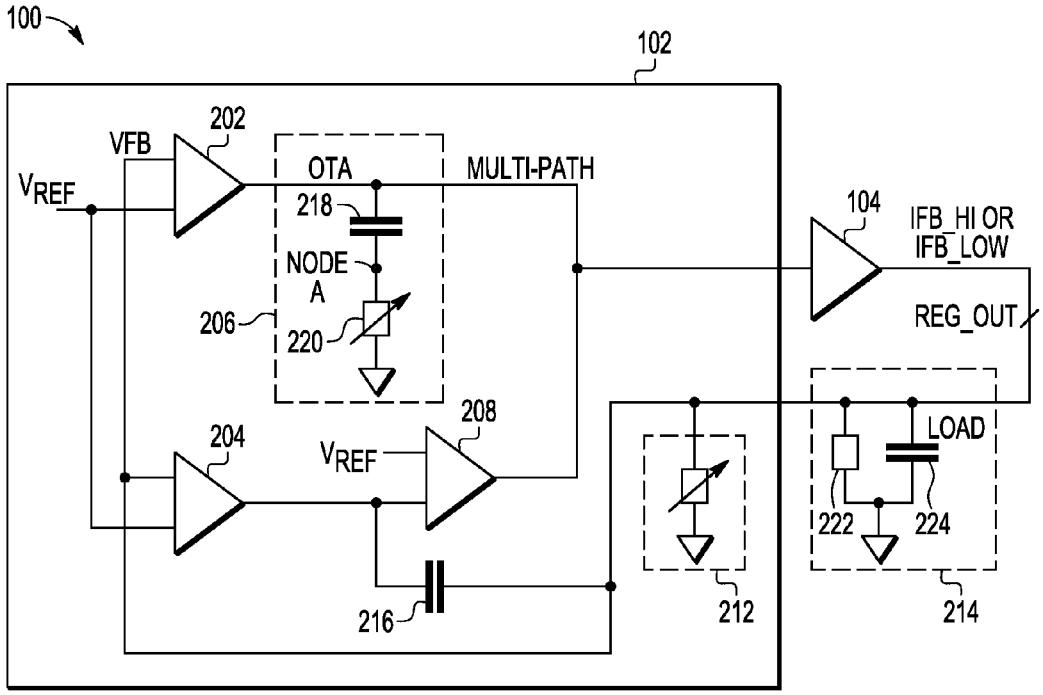
FIG. 2 shows a more detailed block diagram of an amplifier stage of the low dropout (LDO) voltage regulator of FIG. 1.

FIG. 2 shows a more detailed block diagram of amplifier stage 102 of the low dropout (LDO) voltage regulator 100 of FIG. 1 including amplifiers 202, 204, 208, dynamic compensation circuit 206, and minimum current compensation (MCC) circuit 212. Dynamic compensation circuit 206 includes capacitor 218 with one terminal coupled to the output of amplifier 202 and another terminal coupled in series with variable resistive element 220. The output of amplifier 202 is further coupled to the output of amplifier 206 at an input to driver stage 104.

Amplifiers 202 and 204 each include a first input coupled to a feedback voltage VFBand the regulator output signal (REG_OUT). A reference voltage (VREF) is provided a second input of each of amplifiers 202 and 204. An output of amplifier 204 is coupled to an input of amplifier 208 and to a first terminal of capacitor 216. A second input to amplifier 208 is coupled to the reference voltage (VREF) and a second terminal of capacitor 216 is coupled to the output of driver stage 104. The outputs of amplifier 202 and amplifier 208 are coupled at the input to driver stage 104, and can be referred to a multi-path input to driver stage 104. High current feedback (IFB_HI) and low current feedback signal (IFB_LOW) are coupled to dynamic compensation circuit 206 and MCC circuit 212.

MCC circuit 212 is shown as a variable resistive element having a first terminal coupled to the output of driver stage 104 and a second terminal coupled to ground.

Load 214 is represented as resistive element 222 coupled in parallel with capacitor 224. First terminals of resistive element 222 and capacitor 224 are coupled to one another at the output of driver stage 104 and second terminals of resistive element 222 and capacitor 224 are coupled to one another at ground. Load 214 can be implemented on the same substrate as regulator 100. For example, regulator 100 can be implemented as part of a system on a chip (SoC) that includes one or more processors, memory, sensors, and/or other components. Additionally, since regulator 100 does not require an external capacitor, the output of regulator 100 can share a general purpose I/O pin, thus eliminating the need for a dedicated pin for the output of regulator 100.

Amplifier 202 is used as a first gain stage with high transconductance capable of driving a large capacitive load at high frequency but with fairly low gain. Amplifiers 204 and 208 form a second gain stage that provides a DC gain higher than the gain of amplifier 202 required to meet design specifications, such as a gain of 80 dB, even if the cut off frequency of the second gain stage is quite low. The bandwidth of the secondary gain stage (amplifiers 204 and 208) is lower than the bandwidth of the first gain stage (amplifier 202).

Dynamic compensation circuit 206 is used to cancel out a pole and allow for sufficient phase margin since the poles of driver stage 104 and the high frequency stage at amplifier 202 may be too close. Dynamic compensation circuit 206 is coupled to provide a varying level of compensation to the output of amplifier 202. The varying level of compensation is proportional to a current level associated with a load.

When the current in driver 100 is below a specified level, for example, approximately 30 mA, the pole of the driver stage 104 can drop below the allowed range and cause the bandwidth of the regulator 100 to drop below a specified level, such as one MegaHertz (MHz), for example. Accordingly, whenever the load of the regulator drops below the specified current, MCC circuit 212 provides an artificial load that keeps the total driver current at a minimum specified level and preserves the regulator bandwidth. In some embodiments, the artificial load is implemented as a variable resistive element 222 that can be adjusted to achieve the desired bandwidth and provide a constant minimum current level for regulator 100.

Figure 3:
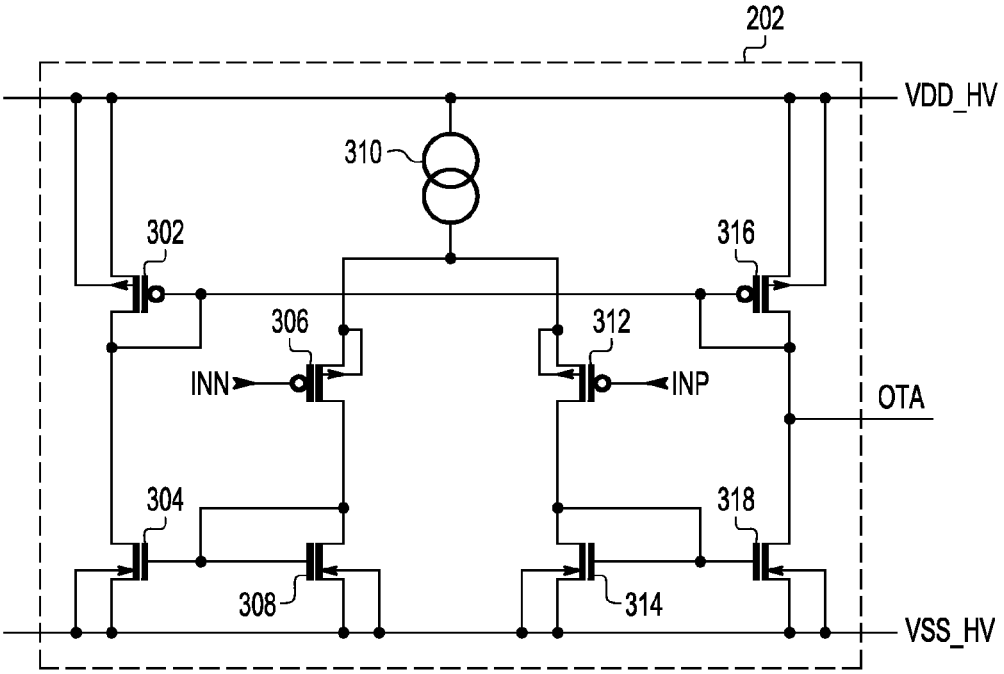
FIG. 3 shows an embodiment of an operational amplifier that may be used in the LDO voltage regulator of FIG. 2.

In some embodiments, regulator 100 can be configured to drive a DC equivalent load ranging from 2 mA to 500 mA with an equivalent capacitance ranging from 5 nano-Farads (nF) to 1000 nF. The DC gain of regulator can be greater than 40-60 decibels (dB) with a bandwidth of 1-10 MHz and a phase margin of at least 30 degrees FIG. 3 shows an embodiment of an operational amplifier 202 that may be used in an amplifier stage 102 of LDO voltage regulator 100 of FIG. 2. Amplifier 202 includes P-channel transistors 302, 306, 312, 316, current source 310, and N-channel transistors 304, 308, 314, 318. Source electrodes of P-channel transistors 302, 316 are coupled to supply voltage VDD_HV. Source electrodes of P-channel transistors 306, 312 are coupled to a first terminal of current source 310. A second terminal of current source 310 is coupled to supply voltage VDD_HV. Drain electrodes of P-channel transistors 302, 306, 312, 316 are coupled to drain electrodes of respective N-channel transistors 304, 308, 314, 318. Source electrodes of N-channel transistors 304, 308, 314, 318 are coupled to supply voltage VSS_HV. A gate electrode of P-channel transistor 302 is coupled to a gate electrode of P-channel transistor 316. A gate electrode of P-channel transistor 306 is coupled to input voltage INN and a gate electrode of P-channel transistor 312 is coupled to input voltage INP. A gate electrode of N-channel transistor 304 is coupled to gate and drain electrodes of diode-connected N-channel transistor 308. A gate electrode of N-channel transistor 318 is coupled to gate and drain electrodes of diode-connected N-channel transistor 314. An output terminal of amplifier 202 is coupled between the drain electrode of P-channel transistor 316 and the drain electrode of N-channel transistor 318 to supply output voltage (OTA).

Figure 4:
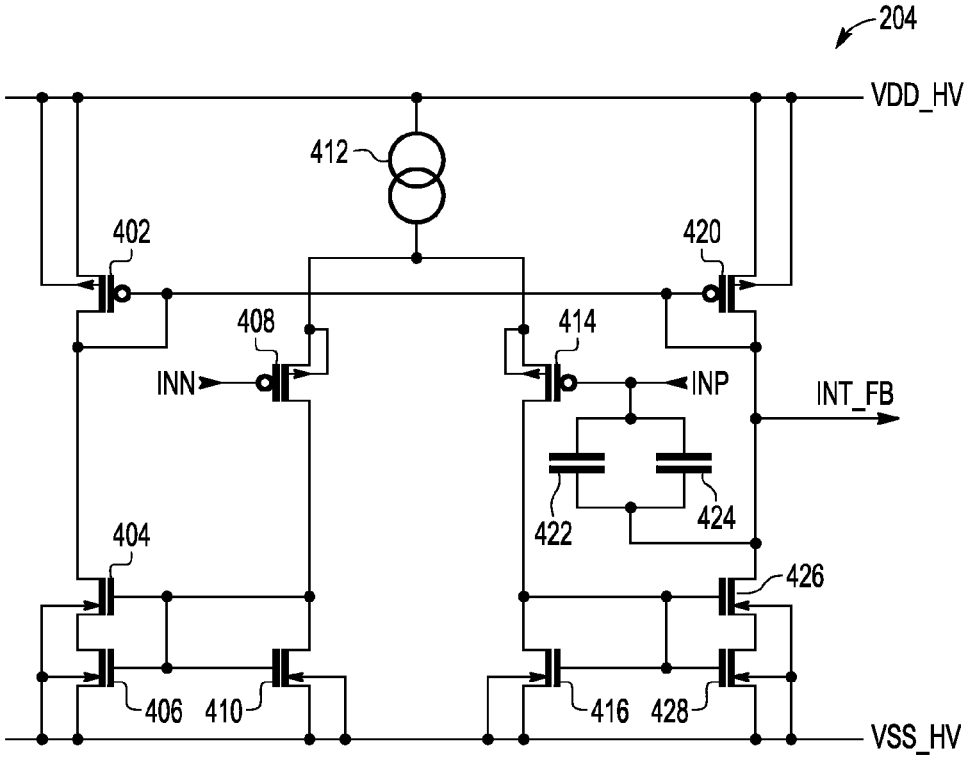
FIG. 4 shows an embodiment of another operational amplifier that may be used in the LDO voltage regulator of FIG. 2.

FIG. 4 shows an embodiment of another operational amplifier 204 that may be used in amplifier section 102 of the LDO voltage regulator 100 of FIG. 2. Amplifier 204 includes P-channel transistors 402, 408, 414, 420, current source 412, capacitors 422, 424, and N-channel transistors 404, 406, 410, 416, 426, 428. Source electrodes of P-channel transistors 402, 420 are coupled to supply voltage VDD_HV. Source electrodes of P-channel transistors 408, 414 are coupled to a first terminal of current source 412. A second terminal of current source 412 is coupled to supply voltage VDD_HV. Drain electrodes of P-channel transistors 408, 414 are coupled to drain electrodes of respective N-channel transistors 410, 416. Drain electrodes of P-channel transistors 402, 420 are coupled to drain electrodes of N-channel transistors 404, 426. Source electrodes of N-channel transistors 404, 426 are coupled to drain electrodes of N-channel transistors 406, 428.

Source electrodes of N-channel transistors 406, 410, 416, 428 are coupled to supply voltage VSS_HV. A gate electrode of P-channel transistor 402 is coupled to a gate electrode of P-channel transistor 420. A gate electrode of P-channel transistor 408 is coupled to input voltage INN and a gate electrode of P-channel transistor 414 is coupled to input voltage INP. Gate electrodes of N-channel transistors 404, 406 are coupled to gate and drain electrodes of diode-connected N-channel transistor 410. Gate electrodes of N-channel transistors 426, 428 are coupled to gate and drain electrodes of diode-connected N-channel transistor 416. The gate electrodes of N-channel transistors 404, 426 are also coupled between the drain electrodes of respective P-channel transistors 408, 414 and the drain electrodes of respective N-channel transistors 410, 416. An output terminal of amplifier 204 is coupled between the drain electrode of P-channel transistor 420 and the drain electrode of N-channel transistor 426 to supply feedback voltage (INT_FE_MST).

Capacitors 422, 424 are coupled in parallel to one another between the gate electrode of P-channel transistor 414 and between the drain electrode of P-channel transistor 420 and the drain electrode of N-channel transistor 426.

Figure 5:
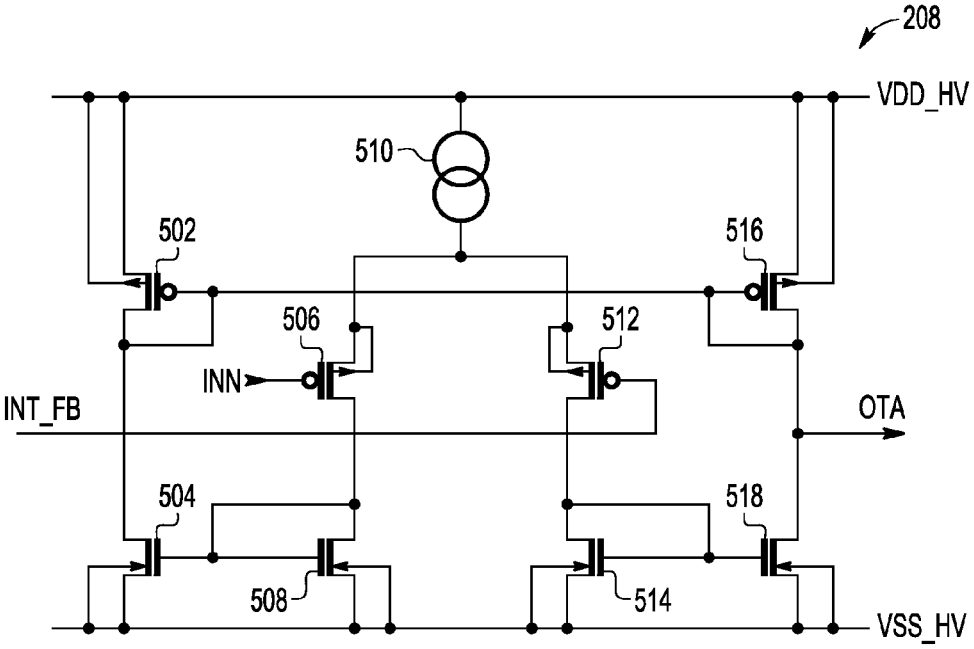
FIG. 5 shows an embodiment of still another operational amplifier that may be used in the LDO voltage regulator of FIG. 2.

FIG. 5 shows an embodiment of still another operational amplifier 208 that may be used in amplifier section 102 of LDO voltage regulator 100 of FIG. 2. Amplifier 208 includes P-channel transistors 502, 506, 512, 516, current source 510, and N-channel transistors 504, 508, 514, 518. Source electrodes of P-channel transistors 502, 516 are coupled to supply voltage VDD_HV. Source electrodes of P-channel transistors 506, 512 are coupled to a first terminal of current source 412. A second terminal of current source 412 is coupled to supply voltage VDD_HV. Drain electrodes of P-channel transistors 502, 506, 512, 516 are coupled to drain electrodes of respective N-channel transistors 504, 508, 514, 518. Source electrodes of N-channel transistors 504, 508, 514, 518 are coupled to supply voltage VSS_HV. A gate electrode of P-channel transistor 502 is coupled to a gate electrode of P-channel transistor 516. A gate electrode of P-channel transistor 506 is coupled to input voltage INN and a gate electrode of P-channel transistor 512 is coupled to feedback voltage (INT_FB_HST). A gate electrode of N-channel transistor 504 is coupled to gate and drain electrodes of diode-connected N-channel transistor 508. A gate electrode of N-channel transistor 518 is coupled to gate and drain electrodes of diode-connected N-channel transistor 514. An output terminal of amplifier 208 is coupled between the drain electrode of P-channel transistor 516 and the drain electrode of N-channel transistor 518 to supply output voltage (OTA).

Figure 6:
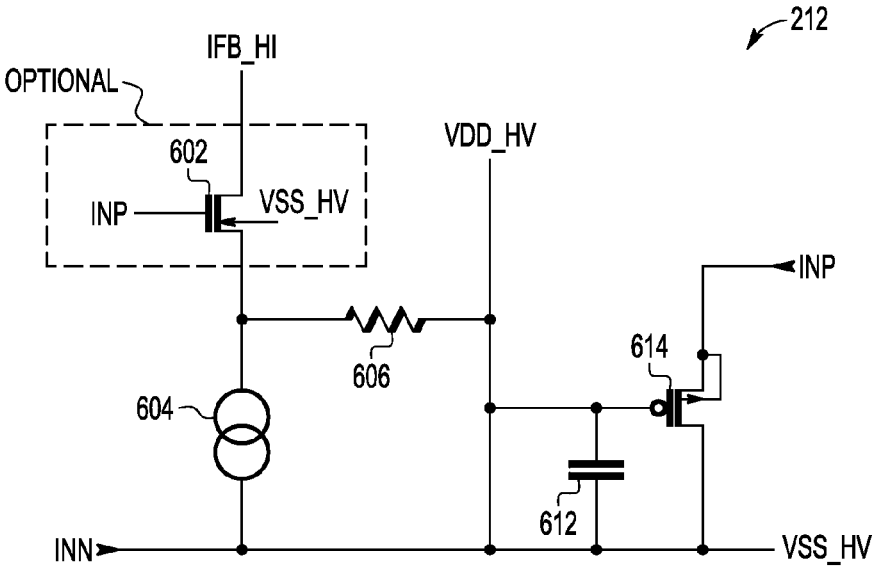
FIG. 6 shows an embodiment of a minimum current compensation circuit that may be used in the LDO voltage regulator of FIG. 2.

FIG. 6 shows an embodiment of a minimum current compensation (MCC) circuit 212 that may be used in amplifier stage 102 of LDO voltage regulator 100 of FIG. 2 including N-channel transistor 602, resistive element 606, current source 604, capacitor 612, and P-channel transistor 614. N-channel transistor 602 has a drain electrode coupled to high current feedback IFB_HI, a gate electrode coupled to input voltage INP, and a source electrode coupled to a first terminal of current source 604 and to a first terminal of variable resistive element 606. A second terminal of current source 604 is coupled to supply voltage VSS_HV and a second terminal of variable resistive element 606 is coupled to a gate electrode of P-channel transistor 614. A source electrode of P-channel transistor 614 is coupled to supply voltage INP, and a drain electrode of P-channel transistor 614 is coupled to supply voltage VSS_HV. Capacitor 612 is coupled between the gate electrode of P-channel transistor 614 and supply voltage VSS_HV.

During operation, when the actual load on regulator 100 is low, MCC circuit 212 can provide an additional load that keeps the total driver current at a specified level to preserve the bandwidth of regulator 100. The amount of additional load can be varied as function of the equivalent resistive load 222, in order to achieve the desired loop bandwidth.

Figure 7:
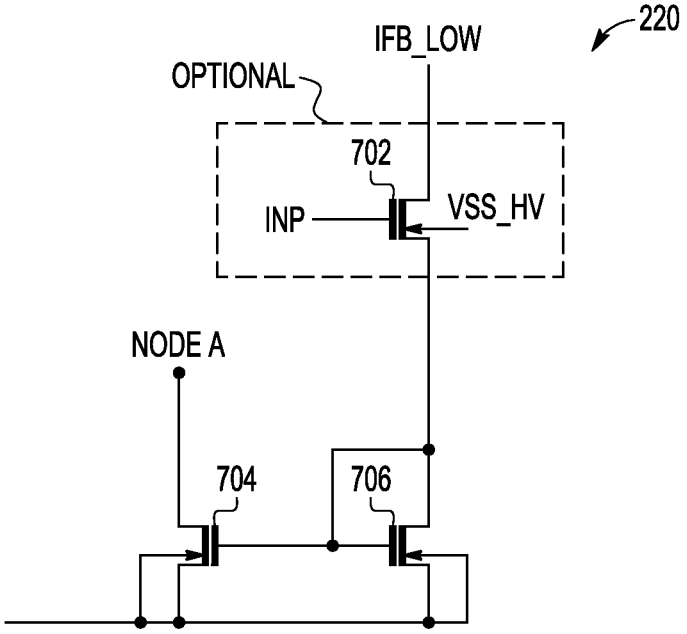
FIG. 7 shows an embodiment of a dynamic compensation circuit that may be used in the LDO voltage regulator of FIG. 2.

FIG. 7 shows an embodiment of a dynamic compensation circuit 220 that may be used in the LDO voltage regulator 100 of FIG. 2 including N-channel transistors 702, 704, 706. N-channel transistor 702 includes a drain electrode coupled to low current feedback IFB_LOW, a gate electrode coupled to input voltage INP, and a source electrode coupled to a drain electrode of N-channel transistor 706. N-channel transistor 704 includes a drain electrode coupled to Node A (as shown in dynamic compensation circuit 206 of FIG. 2), a gate electrode coupled to a gate electrode of N-channel transistor 706, and a source electrode coupled to supply voltage VSS_HV. In addition to a drain electrode coupled to the source electrode of N-channel transistor 702 and a gate electrode coupled to the gate electrode of N-channel transistor 704, N-channel transistor 706 further includes a source electrode coupled to supply voltage VSS_HV.

During operation, since the 0-dB crossing of regulator 100 is load dependent, a constant value resistor would still not provide adequate phase margin over process, temperature, and voltage variations (PTV) and load. Therefore resistive element 220 includes N-channel transistor 704 biased in a linear region. The gate voltage and consequently the equivalent series resistance is modulated by the driver current. Higher driver current will increase the gate voltage and reduce the series resistance, so the compensation zero will track with the 0-dB crossing of regulator 100.

By now it should be appreciated that there has been provided a voltage regulator that can comprise a single substrate including circuitry to implement a first amplifier stage [204, 208] operable to provide a first gain level at a first bandwidth and a second amplifier stage [202] coupled to the first amplifier stage. The second amplifier stage can provide a second gain level at a second bandwidth. The first gain level can be higher than the second gain level, and the second bandwidth can be higher than the first bandwidth. A dynamic compensation circuit [206] can be coupled to the second amplifier stage to provide a varying level of compensation to the second amplifier stage that is proportional to a current level associated with a load. A current compensation circuit [212] can be coupled to an output of a third amplifier stage [104] to allow a minimum current level at the third amplifier stage. The third amplifier stage can be coupled to the first and second amplifier stages.

In another aspect, the minimum current level can be constant.

In another aspect, the minimum current level can be a function of the load.

In another aspect, the dynamic compensation circuit can comprise a transistor coupled in parallel to a compensation resistor [326]. The transistor can have a gate voltage modulated by a current level associated with the third amplifier stage.

In another aspect, the output of the third amplifier stage can be coupled directly to an output pin of the single substrate.

In another aspect, the load can be formed on the single substrate.

In another aspect, the direct voltage gain of the voltage regulator can be greater than forty decibels.

In another aspect, the voltage regulator can be responsive to a direct current equivalent load within the range of two to five hundred milliamps (2-500 mA).

In another aspect, an equivalent capacitance coupled to an output of the voltage regulator can be within the range of five to one hundred nanofarads (5-100 nF).

In another aspect, the voltage regulator can be operable to provide a phase margin greater than thirty degrees.

In another aspect, the current compensation circuit can comprise a first transistor of the first type [604] having a first current electrode coupled to an input signal and a first electrode of a resistor [606], a control electrode coupled to a bias voltage, and a second current electrode coupled to a first supply voltage, a capacitor [612] coupled in parallel between a second electrode of the resistor and the first supply voltage, and a first transistor of a second type [614] having a first current electrode coupled to an input voltage, a control electrode coupled to the second electrode of the resistor, and a second current electrode coupled to a second supply voltage.

In another aspect, the dynamic compensation circuit can comprise a first transistor of a first type [704] having a first current electrode coupled to an output of the second amplifier stage, a second current electrode coupled to a source voltage, and a second transistor [706] of the first type having a first current electrode coupled to the source voltage, and a second current electrode and a control electrode coupled to: one another, a control electrode of the first transistor of the first type, and an input signal.

In other embodiments, a semiconductor device can comprise a load [214], and a voltage regulator [100] coupled to the load. The voltage regulator can comprise a multipath amplifier stage [102], a driver stage [104] coupled to the multipath amplifier stage, and a dynamic compensation circuit [206] coupled to the multipath amplifier stage. The dynamic compensation circuit can be operable to provide a varying level of compensation to the multipath amplifier stage that is proportional to a current level associated with the load. A current compensation circuit [212] can be coupled to an output of the driver stage to allow a minimum current level at the driver stage.

In another aspect, the load and the voltage regulator can be formed on the same substrate.

In another aspect, an output of the driver stage can be directly coupled to an output pin of the semiconductor device.

In another aspect, the minimum current level can be constant.

In another aspect, the minimum current level can be a function of the load.

In another aspect, the dynamic compensation circuit can comprise a transistor coupled in parallel to a compensation resistor. The transistor can have a gate voltage modulated by a current level associated with the third amplifier stage.

In another aspect, the current compensation circuit can comprise a first transistor of the first type [604] having a first current electrode coupled to an input signal and a first electrode of a resistor [606], a control electrode coupled to a bias voltage, and a second current electrode coupled to a first supply voltage, a capacitor [612] coupled in parallel between a second electrode of the resistor and the first supply voltage, and a first transistor of a second type [614] having a first current electrode coupled to an input voltage, a control electrode coupled to the second electrode of the resistor, and a second current electrode coupled to a second supply voltage.

In another aspect, the dynamic compensation circuit can comprise a first transistor of a first type [704] having a first current electrode coupled to an output of the multipath amplifier stage, a second current electrode coupled to a source voltage, and a second transistor of the first type [706] having a first current electrode coupled to the source voltage, and a second current electrode and a control electrode coupled to: one another, a control electrode of the first transistor of the first type, and an input signal.

Because the apparatus implementing the present disclosure is, for the most part, composed of electronic components and circuits known to those skilled in the art, circuit details will not be explained in any greater extent than that considered necessary as illustrated above, for the understanding and appreciation of the underlying concepts of the present disclosure and in order not to obfuscate or distract from the teachings of the present disclosure.

Although the disclosure has been described with respect to specific conductivity types or polarity of potentials, skilled artisans appreciated that conductivity types and polarities of potentials may be reversed.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the disclosure described herein are, for example, capable of operation in other orientations than those illustrated or otherwise described herein.

Thus, it is to be understood that the architectures depicted herein are merely exemplary, and that in fact many other architectures can be implemented which achieve the same functionality. In an abstract, but still definite sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Also for example, in one embodiment, the illustrated elements of system 100 are circuitry located on a single integrated circuit or within a same device.

Furthermore, those skilled in the art will recognize that boundaries between the functionality of the above described operations merely illustrative. The functionality of multiple operations may be combined into a single operation, and/or the functionality of a single operation may be distributed in additional operations. Moreover, alternative embodiments may include multiple instances of a particular operation, and the order of operations may be altered in various other embodiments.

Although the disclosure is described herein with reference to specific embodiments, various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure. Any benefits, advantages, or solutions to problems that are described herein with regard to specific embodiments are not intended to be construed as a critical, required, or essential feature or element of any or all the claims.

The term "coupled," as used herein, is not intended to be limited to a direct coupling or a mechanical coupling.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to disclosures containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. A voltage regulator comprising:

a single substrate including circuitry to implement:

a first amplifier stage operable to provide a first gain level at a first bandwidth;

a second amplifier stage coupled to the first amplifier stage, the second amplifier stage operable to provide a second gain level at a second bandwidth, wherein the first gain level is higher than the second gain level, and the second bandwidth is higher than the first bandwidth;

a dynamic compensation circuit coupled to an output of the second amplifier stage, the dynamic compensation circuit operable to provide a varying level of compensation to the second amplifier stage, the varying level of compensation proportional to a current level associated with a load; and a current compensation circuit coupled to an output of a third amplifier stage, the current compensation circuit operable to allow a minimum current level at the third amplifier stage, the third amplifier stage coupled to the first and second amplifier stages.

2. The voltage regulator of claim 1, wherein the minimum current level is constant.

3. The voltage regulator of claim 1, wherein the minimum current level is a function of the load.

4. The voltage regulator of claim 1, wherein the dynamic compensation circuit comprises a transistor having a gate voltage modulated by a current level associated with the third amplifier stage.

5. The voltage regulator of claim 1, wherein the output of the third amplifier stage is coupled directly to an output pin of the single substrate.

6. The voltage regulator of claim 1, wherein the load is formed on the single substrate.

7. The voltage regulator of claim 1, wherein the direct voltage gain of the voltage regulator is greater than forty decibels.

8. The voltage regulator of claim 1, wherein the voltage regulator is responsive to a direct current equivalent load within the range of two to five hundred milliamps (2-500 mA).

9. The voltage regulator of claim 1, wherein an equivalent capacitance coupled to an output of the voltage regulator is within the range of five to one hundred nanofarads (5-100 nF).

10. The voltage regulator of claim 1, wherein the voltage regulator is operable to provide a phase margin greater than thirty degrees.

11. The voltage regulator of claim 1, wherein the current compensation circuit comprises:

a first transistor of the first type having a first current electrode coupled to a first electrode of a resistor, a control electrode coupled to a bias voltage, and a second current electrode coupled to a first supply voltage;

a capacitor coupled in parallel between a second electrode of the resistor and a second supply voltage; and a first transistor of a second type having a first current electrode coupled to an input voltage, a control electrode coupled to the second electrode of the resistor, and a second current electrode coupled to the second supply voltage.

12. The voltage regulator of claim 1, wherein the dynamic compensation circuit comprises:

a first transistor of a first type having a first current electrode coupled to an output of the second amplifier stage, a second current electrode coupled to a source voltage; and a second transistor of the first type having a first current electrode coupled to the source voltage, and a second current electrode and a control electrode coupled to: one another, and a control electrode of the first transistor of the first type.

13. A semiconductor device comprising:

a load;

a voltage regulator coupled to the load, the voltage regulator comprising:

a multipath amplifier stage;

a driver stage coupled to the multipath amplifier stage;

a dynamic compensation circuit coupled to the multipath amplifier stage, the dynamic compensation circuit operable to provide a varying level of compensation to the multipath amplifier stage, the varying level of compensation proportional to a current level associated with the load; and a current compensation circuit coupled between the load and the input to the multipath amplifier stage, the current compensation circuit operable to provide a minimum current level at the driver stage and includes:

a first transistor of the first type having a first current electrode coupled to an input signal and a first electrode of a resistor, a control electrode coupled to a bias voltage, and a second current electrode coupled to a first supply voltage;

a capacitor coupled in parallel between a second electrode of the resistor and the first supply voltage; and a first transistor of a second type having a first current electrode coupled to an input voltage, a control electrode coupled to the second electrode of the resistor, and a second current electrode coupled to a second supply voltage.

14. The semiconductor device of claim 13, wherein the load and the voltage regulator are formed on the same substrate.

15. The semiconductor device of claim 13, wherein an output of the driver stage is an output of the semiconductor device.

16. The semiconductor device of claim 13, wherein the minimum current level is constant.

17. The semiconductor device of claim 13, wherein the minimum current level is a function of the load.

18. The semiconductor device of claim 13, wherein the dynamic compensation circuit comprises a transistor coupled to a compensation resistor, the transistor having a gate voltage modulated by a current level associated with a third amplifier stage.

19. The semiconductor of claim 13, wherein the dynamic compensation circuit comprises:

a first transistor of a first type having a first current electrode coupled to an output of the multipath amplifier stage, a second current electrode coupled to a source voltage; and a second transistor of the first type having a first current electrode coupled to the source voltage, and a second current electrode and a control electrode coupled to: one another, a control electrode of the first transistor of the first type, and an input signal.

* * * * *